US005755271A

United States Patent [19]

Williamson

[11] Patent Number: 5,755,271

[45] **Date of Patent: *May 26, 1998**

[54] METHOD FOR CASTING A SCROLL

[75] Inventor: Warren Gathings Williamson, Sidney, Ohio

[73] Assignee: Copeland Corporation, Sidney, Ohio

[ * ] Notice: The term of this patent shall not extend beyond the expiration date of Pat. No. 5,580,401.

[21] Appl. No.: 579,785

[22] Filed: Dec. 28, 1995

[51] Int. Cl.[6] ..... B22C 9/02

[52] U.S. Cl. ..... 164/34; 164/520

[58] Field of Search ..... 164/34, 529, 520, 164/122

[56] References Cited

U.S. PATENT DOCUMENTS

| | | | |
|---|---|---|---|
| 4,403,494 | 9/1983 | McCullough . | |
| 4,463,591 | 8/1984 | McCullough . | |
| 4,512,066 | 4/1985 | McCullough . | |
| 4,603,665 | 8/1986 | Hesterberg et al. . | |
| 4,666,516 | 5/1987 | Hornung et al. . | |
| 4,821,694 | 4/1989 | Hesterberg et al. . | |
| 4,966,220 | 10/1990 | Hesterberg et al. . | |
| 4,969,428 | 11/1990 | Donahue et al. . | |
| 5,125,810 | 6/1992 | Suefiji et al. . | |
| 5,252,273 | 10/1993 | Sakai et al. . | |
| 5,275,543 | 1/1994 | Tanaka et al. . | |
| 5,277,562 | 1/1994 | Fukuhara et al. . | |
| 5,342,184 | 8/1994 | Comparin et al. . | |
| 5,355,930 | 10/1994 | Donahue et al. . | |
| 5,355,931 | 10/1994 | Donahue et al. | 164/34 |
| 5,368,446 | 11/1994 | Rode . | |
| 5,370,513 | 12/1994 | Fain . | |
| 5,388,973 | 2/1995 | Richardson, Jr. . | |
| 5,392,512 | 2/1995 | Fann et al. . | |
| 5,580,401 | 12/1996 | Williamson | 148/321 |

FOREIGN PATENT DOCUMENTS 739125 6/1980 U.S.S.R. .

OTHER PUBLICATIONS

Commonly owned co–pending U.S. Patent Application, Ser. No. 08/403,455 (filed Mar. 4, 1995) (Williamson).

Expandable Pattern Casting by Raymond W. Monroe (1992) (American Foundrymen's Society).

Metals Handbook, 9th Ed., vol. 15, pp. 629–646 (1988).

The Precision Lost Foam Casting Process by R.J. Donahue and T. M. Cleary, Mercury Marine, Lost Foam Technologies and Applications Conference Proceedings, Sep. 11–13, 1995 (Akron, Ohio) (American Foundrymen's Society).

Hypereutectic Aluminum–Silicon Alloys for Lost Foam, by Raymond J. Donahue, AFS, Int'l. Expandable Pattern Casting Conference Proceedings, Rosemont, Illinois (Jun. 5–7, 1991) pp. 301–324.

*Primary Examiner*—Scott A. Smith
*Assistant Examiner*—I.-H. Lin
*Attorney, Agent, or Firm*—Harness, Dickey & Pierce, P.L.C.

[57] ABSTRACT

A lost foam casting method for the manufacture of scrolls.

17 Claims, 4 Drawing Sheets

METHOD FOR CASTING A SCROLL

TECHNICAL FIELD

The present invention relates to an improved casting method, and more particularly to an improved method for casting a component for a scroll machine.

BACKGROUND AND SUMMARY OF THE INVENTION

Scroll machines are widely employed in various applications. Recent examples of scroll machines for fluid compression or expansion, without limitation, are addressed in recent U.S. Pat. Nos. 5,342,184, 5,368,446 and 5,370,513, hereby expressly incorporated by reference. In general, scrolls employed in scroll machines may be of a variety of different types. Examples of scroll types include, without limitation, rotating, orbiting and fixed types. Ordinarily at least two scrolls are used, in co-acting combination with each other, in a scroll machine. At least one of the scrolls is a metallic structure having intricate geometries. For instance, typical scroll structures incorporate a plurality of adjoining sections having relatively large section thickness differentials or gradients relative to each other. In service, these scrolls often times encounter strenuous working conditions, and thereby desirably employ materials that will exhibit excellent wear resistance and strengths on the order of 250 MPa or greater. In view of the complexities of shape, and taking into account other material property and processibility requirements, it has been common to manufacture scrolls by casting the scrolls with a cast iron material, such as a gray or ductile iron, or from nonferrous alloys such as aluminum alloys.

The use of presently available casting materials has presented limitations in improving the design of scrolls and in designing cost effective procedures for the manufacture of scrolls. By way of example, the trend has been toward reducing time consuming machining operations, such as by seeking to reduce finish stock allowances to less than about several millimeters, while at the same time reducing section thicknesses and optimizing the material strengths.

Owing to the need for precise dimensional tolerances, and in view of the complexity of shape of the scroll member, scroll members normally have been fabricated from solid billet, cast (such as by die casting, squeeze casting, green sand casting with or without cores, or shell mold casting) or forged from rough shapes or billets engineered to provide appropriate amounts of finish stock. The scrolls thereafter are precision machined and finished using high precision techniques.

A disadvantage inherent in the techniques above is that they do not provide considerable potential for optimizing overall material yield. Further, the machining and finishing steps consume considerable time and tooling.

One possible approach to improving the efficiency of the scroll manufacture method is to employ a system that permits for better as-cast properties. This is the subject of commonly owned copending U.S. patent application, Ser. No. 08/403,455, filed Mar. 4, 1995 (Williamson) and now issued as U.S. Pat. No. 5,580,401, hereby expressly incorporated by reference.

Another possible approach, and the approach to which the method of this invention is directed is to employ a casting method that overcomes the various known disadvantages of commonly employed casting methods and permits for achieving high quality as-cast scroll components requiring relatively little postcasting machining and finishing.

The use of lost foam casting to produce a scroll component has heretofore proved itself impracticable because of the complexity of the scroll member configuration, and the differences in thickness of the various sections of the scroll member. Aspects of conventional lost foam molding techniques are disclosed in *Expandable Pattern Casting*, by Raymond W. Monroe (1992), hereby incorporated by reference.

Accordingly, it is an object of the present invention to provide a method for casting a scroll member that permits for high dimensional accuracy in the as-cast state.

It is another object to provide a method for casting a scroll member that permits for eliminating coring operations while still achieving complex casting configurations heretofore typically achieved by requiring the use of cores.

It is another object of the present invention to provide a method for casting a scroll member that results, as-cast, in a cast article having a relatively smooth surface finish and is substantially free of sand mold parting lines and other potential undesirable attributes of conventional cope and drag sand molding techniques.

It is yet another object of the present invention to provide a method that readily permits for simplified in-mold inoculation, particularly where casting a thin section gray iron scroll.

It is yet another object of the present invention to cast a scroll member that is reduced in overall mass, as-cast, relative to conventional scroll members by the generation of holes (blind or through holes) in heretofore difficult to achieve locations absent the use of cores.

It is yet another object of the present invention to provide a molding method that accommodates sand thermal expansion and thereby results in scroll components having improved dimensional accuracy along all axes.

The present invention satisfies the above by providing an improved method for casting a scroll member. Other advantages and objects of the present invention will become apparent to those skilled in the art from the subsequent detailed description, the drawings and appended claims.

BRIEF DESCRIPTION OF THE DRAWINGS

The various advantages of the present invention will become apparent to one skilled in the art by reading the following specification and subjoined claims and by referencing the following in which:

DETAILED DESCRIPTION OF THE PREFERRED EMBODIMENTS

Figure 1:
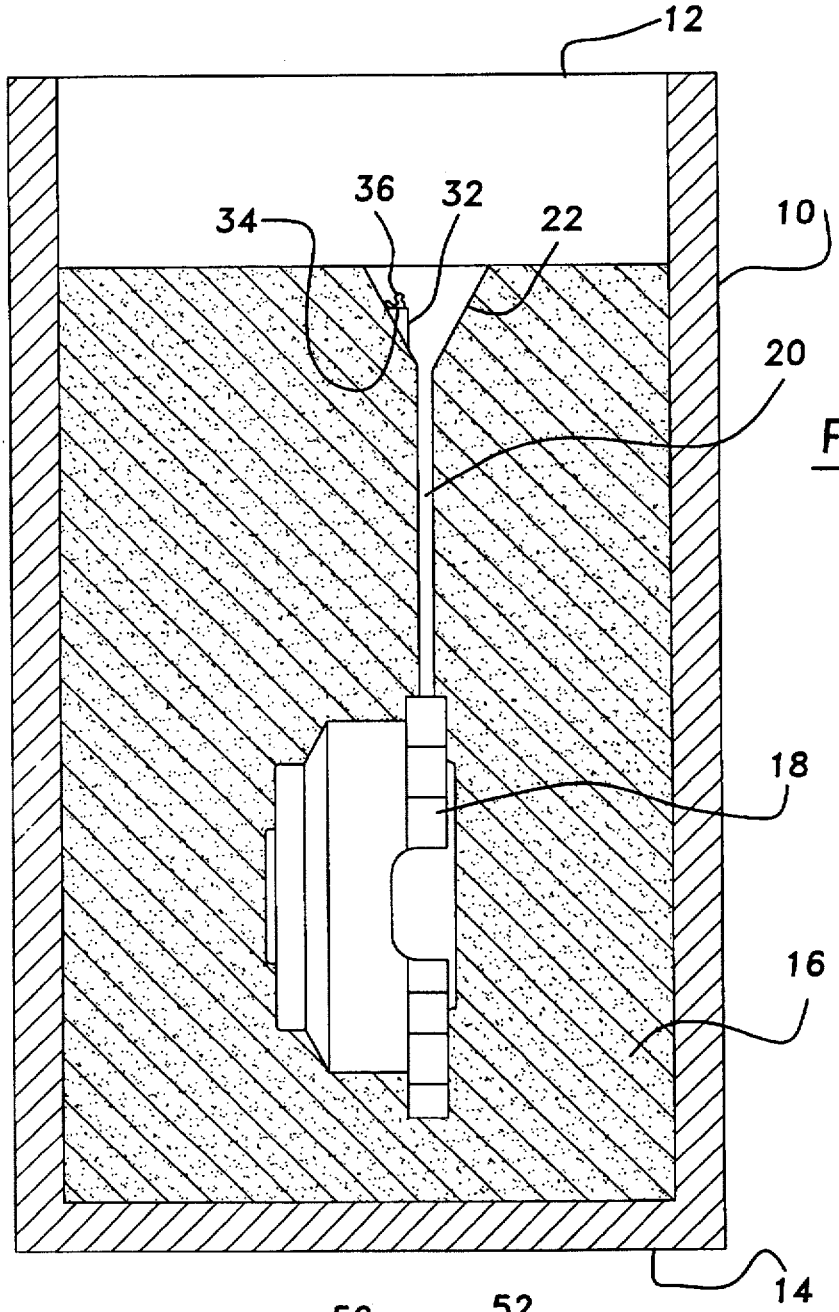
FIG. 1 is an elevational view of a scroll member pattern through a section of a mold flask prior to casting.
Figure 3:
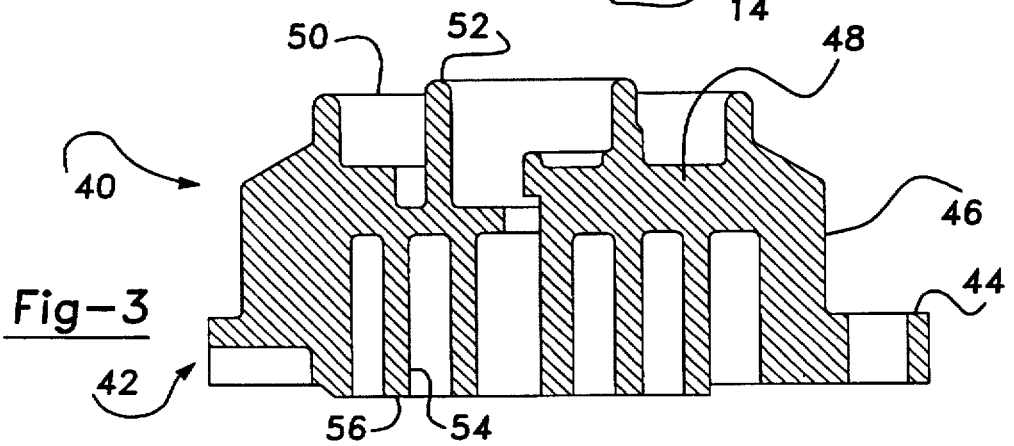
FIG. 3 is a side sectional view (through 3—3) of the casting of FIG. 2.

The method of the present invention includes the steps of:

1) placing a pattern configured as a scroll member into a molding tool;
2) surrounding substantially the entirety of the pattern with a refractory material;
3) decomposing the pattern in order to define a cavity in the molding tool having the configuration of the pattern; and
4) pouring a sufficient quantity of a molten metal into the molding tool in order to fill the cavity defined by the pattern to obtain a cast scroll member upon solidification of said molten metal.

In a preferred embodiment of the present invention, a scroll member is manufactured using a lost foam casting method. Thus, preferably the patterns employed in the method of the present invention are prepared, with the exceptions as set forth herein, in accordance with conventional techniques for the manufacture of patterns for lost foam casting. The skilled artisan should be aware of such techniques as they are described throughout the literature, including but not limited to *Expandable Pattern Casting*, by Raymond W. Monroe (1992), Chs. 5 and 6, hereby expressly incorporated by reference.

PREFERRED ALLOY COMPOSITION AND MELT PRACTICE

Percentages are expressed in percent, by weight, unless otherwise stated herein. In a preferred embodiment, the resulting cast scroll member is composed of a material having a minimum tensile strength of at least about 250 MPa, and an average hardness of about Bhn 187 to about 241. Preferably the material is a ferrous alloy.

Suitable ferrous alloys preferably include iron, as a base material (i.e. greater than about 50%, and more preferably greater than about 85%, by weight of the base material) along with carbon, silicon, and manganese in predetermined amounts, and more preferably is a gray iron. Gray iron is addressed in Metals Handbook, 9th Ed., Vol. 15, pp. 629–646, hereby expressly incorporated by reference. In one embodiment, the preferred gray iron alloy may include one or more alloys such as those described in copending commonly owned U.S. application, Ser. No. 08/403,455, (both the prior alloys and the improved alloy of that application), hereby incorporated by reference.

More particularly, for a preferred base material, carbon is present in the base material in an amount ranging from about 2.5% to about 3.9%, by weight of the base material, and more preferably about 3.3%, by weight of the base material. Silicon is present in the base material in an amount ranging from about 1.5% to about 3%, by weight of the base material, and more preferably about 1.7%, by weight of the base material. Manganese is present in the base material in an amount ranging from about 0.3% to about 1.0%, by weight of the base material, and more preferably about 0.6%, by weight of the base material. The skilled artisan will appreciate that higher or lower contents than the above may be suitably employed. For instance, for larger castings, lower carbon or silicon levels may be employed to arrive at the desired structure.

Trace amounts of one or more impurities are acceptable in the ferrous base material. For instance, it is contemplated that impurities may be present in the amounts (expressed in percent, by weight of the base material) up to about those shown in Table 2.

TABLE 2

| Element | Approximate Maximum |
|---|---|
| Sulfur | 0.15% |
| Phosphorus | 0.07% |
| Lead | 0.003% |
| Aluminum | 0.01% |

The ferrous base material is prepared in any suitable manner. Upon preparation, it is maintained at a first temperature of at least about 2690° F. (1477° C.), in a suitable furnace, preferably a melting furnace (e.g., electric or induction melt furnace) or a holding furnace, under any suitable atmosphere. Where cupola melting is employed, suitable oxygen enrichment techniques may be employed.

After melting the ferrous base material, while still at a temperature greater than about 2690° F. (1477° C.), resulting molten metal preferably is tapped, at any suitable flow rate, into a transfer or pouring ladle suitable for the manufacture of gray cast iron. A conventional teapot ladle may be used for either such ladle. A conventional bottom tapped ladle may also be employed for pouring. As to the latter, it is preferable to employ a graphite stopper attached to a rod for moving the stopper into and out of stopping engagement with the tap hole of the ladle.

In accordance with the teachings of Serial No. 08/403,455, at about the time when the molten metal is being tapped into the transfer or pouring ladle, optionally, such molten metal may be treated with a predetermined amount of a high performance inoculant, which preferably is introduced to the molten metal via a suitable carrier (e.g. as part of a ferrosilicon base material additive). In another highly preferred embodiment, in-mold inoculation, such as with a high performance inoculant, is employed in accordance with the teachings discussed later herein. By "high performance inoculant" as used herein, it is meant one or more elements that will promote the formation of the type A graphite flakes in the cast material, while reducing the tendency to form chill (i.e., white iron or eutectic carbide ($Fe_3C$)). Without intending to be bound by theory it is believed that the high performance inoculant increases the amount and stability of nuclei (e.g., without limitation, strontium carbide, where strontium is the inoculant) present in the molten iron, to help thereby achieve the desired microstructure.

The preferred high performance inoculants employed herein include one or more elements selected from the group consisting of strontium, a lanthanide series rare earth element and mixtures thereof. More preferably the inoculant is selected from the group consisting of strontium, cerium, yttrium, scandium, neodymium, lanthanum and mixtures thereof. Still more preferably the inoculant is selected from the group consisting of strontium, cerium and mixtures thereof. Suitable high performance inoculants also may incorporate inoculants discussed in Table 5, page 637, Volume 15, Metals Handbook (9th Ed.), hereby incorporated by reference. For example, inoculants also may be added, such as barium, calcium, titanium, zirconium or mixtures thereof. A most preferred high performance inoculant is a strontium inoculant.

Preferably the amount of high-performance inoculant is sufficient to result (after any fade or lack of pickup of the inoculant in the melt) in the desired microstructure and properties as discussed herein. This ordinarily entails inoculating with a strontium inoculant whereby strontium is provided in a ferrosilicon carrier so that the concentration of strontium is about 0.6% to about 1.0% and more preferably about 0.8%, by weight of the overall high-performance inoculant and carrier combination, and silicon is present from about 73% to about 78% and more preferably about 75%, by weight of the overall high-performance inoculant and carrier combination. The high-performance inoculant and carrier combination is added to the molten ferrous base metal in an amount of about 0.4% to about 0.8%, by weight of the molten metal being inoculated. As the skilled artisan will appreciate, higher or lower amounts may be employed.

The skilled artisan will appreciate that the amounts of the high performance inoculant employed in the present invention as well as any other inoculants (as discussed herein) are not critical but are selected with reference to the desired as cast microstructure and properties. Accordingly, factors such as the anticipated fade, recovery, and other processing considerations that would effect the ability of the inoculant to function for nucleation purposes, may be taken into consideration and adjusted accordingly. Thus, the amounts recited herein are for purposes of illustration, but are not intended as limiting. Further, while the final as cast composition tends to result in a composition having in the range of about 3 to about 100 ppm of the high performance inoculant element, that concentration is not critical, provided that the microstructure as described herein is accomplished using the high-performance inoculant, when so employed. Further, where the inoculant is not strontium, by itself, it may be possible that higher concentrations of the high-performance inoculant may be anticipated or expected in the final as cast composition.

The above step of inoculation may optionally be combined, either before, during or after inoculation, with an additional step of further alloying the molten metal, with one or more additional alloying elements, preferably to achieve, without limitation, pearlite stabilization in the microstructure of the cast material.

When the inoculation step is combined with a further step of alloying the molten metal, the preferred alloying elements are selected from the group consisting of copper, tin, chromium, antimony and mixtures thereof. Preferably, the alloying elements are selected and added in specific predetermined amounts to help achieve a minimum strength in the resulting as cast material of at least about 250 MPa, and a substantially entirely pearlitic matrix microstructure throughout the material. The skilled artisan will appreciate that other suitable pearlite stabilizing agents may likewise be employed in suitable concentrations.

Suitable alloying elements may also be added in suitable amounts for purposes other than pearlite stabilization (e.g. to retard wear or to refine graphite). Examples of other possible alloying elements include elements such as nickel, molybdenum, titanium or mixtures thereof.

In a preferred embodiment, one or more of the alloying elements are employed to achieve the approximate concentrations (expressed relative to the final resulting cast composition), recited in Table 3.

TABLE 3

| Element | Preferred | More Preferred |
|---|---|---|
| Copper | about 0.20 to about 1.0% | up to about 0.90% |
| Tin | about 0.025 to about 0.20% | up to about 0.15% |

TABLE 3-continued

| Element | Preferred | More Preferred |
|---|---|---|
| Chromium | about 0.05 to about 0.2% | up to about 0.17% |
| Antimony | about 0.01 to about 0.2% | up to about 0.04% |

In yet another more preferred embodiment, the alloying elements are employed in a combination including (expressed in terms of percent by weight of the final resulting cast composition) about 0.6% copper, about 0.12% tin, about 0.10% chromium and about 0.03% antimony. In this manner, it is believed possible to avoid potentially undesirable effects, particularly in cast scroll structures. For instance, without intending to be bound by theory, it is believed that when employed in combinations other than the present most preferred composition, and at levels higher than the disclosed ranges, for scroll castings, copper tends to refine the resulting pearlite, tin or antimony tends to embrittle the iron, and chromium tends to promote formation of undesirable amounts of eutectic carbide. Further, it is not believed possible to optimize the beneficial effects of antimony on the casting skin unless used in the present amount or in the present most preferred combination.

Of course, as the skilled artisan will appreciate, factors such as the molding method employed or the specific casting design may potentially affect the amount or type of alloying elements employed to achieve the required mechanical properties and pearlite stabilization in the resulting cast material. Thus, the above alloying elements may be adjusted upwardly or downwardly or used in different combinations to achieve a desired result. For example, antimony and tin can be used in smaller amounts than set forth in the most preferred embodiment.

After inoculation, the carbon equivalent preferably should be about 4.1%. As used herein, "carbon equivalent" refers to the sum of the carbon content plus the product of 0.33 multiplied by the silicon content. Accordingly, adjustment of the silicon or carbon levels may be made, such as by trimming carbon levels through additions of steel, by raising carbon levels through carbon raisers (e.g. containing graphite), by inoculating with silicon as hereinafter described or any other suitable way.

During the steps of inoculation (where ladle inoculation is used) and alloying element addition, in accordance with the above, the molten metal is maintained at a temperature preferably greater than about 2690° F. (1477° C.). Just prior to pouring, preferably the molten metal is adjusted downward to a pouring temperature of as low as about 2500° F. (1371° C.). By way of example, without limitation, for smaller castings (e.g. about 1 kg), the temperature is preferably brought to about 2640° F. (1449° C.). For larger castings (e.g. about 3 kg), the temperature is preferably brought to about 2510° F. (1377° C.). This may be done using any suitable technique for relatively rapidly reducing the temperature of the molten metal (e.g., to help avoid fade of the high performance inoculant and to improve production efficiency), such as conventional chill techniques, wherein scrap gray iron castings may be added to the melt. Of course, higher or lower temperatures are possible, depending upon mold type, shape or material, control over shrinkage and other like considerations. For instance, the pouring temperature may be as high as about 2750° F. (1510° C.), such as when the temperature during ladle inoculation is greater than about 2750° F. (1510° C.).

Preferably, particularly inoculation other than in-mold inoculation, the time between inoculation with the high performance inoculant and pouring of the molten metal into a mold (e.g., a mold flask) should not exceed the time for fade (i.e. nuclei reduction), wherein subsequent solidification would result in formation of undesirable eutectic carbide, or undercooled structures, as the high performance inoculant becomes ineffective over time for achieving ultimate desired microstructure. Preferably, the time should not exceed about 8 minutes and more preferably should not exceed about 6 minutes.

Though any suitable amounts of molten metal may be treated and transferred in the transfer ladle, preferred amounts for the manufacture of scrolls range from about 600 to about 1000 pounds.

In a highly preferred embodiment, where a high performance inoculant (e.g., strontium) is employed, to help aid pearlite stability, particularly in the casting skin, the final composition of the as-cast material includes about 3.0 to about 3.9% carbon, and more preferably about 3.42% carbon; about 1.9 to about 2.3% silicon, and more preferably about 2.05% silicon; about 0.2 to about 1.25% manganese, and more preferably about 0.62% manganese; about 0.2 to about 1.0% copper, more preferably 0.4 to about 0.55% copper and still more preferably about 0.45% copper; about 0.08 to about 0.18% tin, and more preferably about 0.15% tin; about 0.02 to about 0.2% chromium, and more preferably up to about 0.05% chromium; about 0.01 to about 0.2% antimony, and more preferably about 0.017% antimony; up to about 0.08% sulfur; up to about 0.05% phosphorus; up to about 0.01 and more preferably up to about 0.015% titanium, and about 3 to about 100 ppm strontium and more preferably about 6 to about 70 ppm strontium. Where other high-performance inoculants are used, rather than just strontium, a preferred composition is the same as the above, substituting the high-performance inoculant for strontium in approximately the same or a greater amount. For example, if cerium or another rare earth element (either with or without cerium) is employed as a high performance inoculant, it may be added and could result in a concentration up to about ten times greater than the preferred concentration for strontium discussed herein.

In a particularly preferred embodiment, the resulting microstructure in a gray iron cast scroll member includes a matrix of generally medium to coarse lamellar pearlite and having less than about 7% by volume free ferrite and less than about 3% by volume free carbides. The graphite structure preferably has a minimum of about 75% by volume type A flakes, and more preferably at least about 80% by volume, with a flake size generally not exceeding about 0.5 mm.

Alternatively, in another preferred embodiment, the material for the cast scroll member is an aluminum alloy. For instance, a preferred aluminum alloy is a Mercosil® or Super Mercosil® aluminum alloy, the latter aluminum alloys being available commercially from Brunswick Corporation, Skokie, Il. (see also, Hypereutectic Aluminum-Silicon Alloys for Lost Foam, by Raymond J. Donahue, AFS, Int'l Expendable Pattern Casting Conference Proceedings, Rosemont, Ill. (Jun. 5–7, 1991), pp. 301–324; and U.S. Pat. Nos. 4,603,665; 4,821,694; 4,966,220; and 4,969,428, all of which are hereby expressly incorporated by reference).

Examples of particularly preferred aluminum alloys, such as Mercosil® and a "low-silicon" version of Super Mercosil® (a high silicon version such as the "low-silicon" version of Mercosil®, but containing about 22 to about 25% silicon, may alternatively be employed if desired) include those in the following Table 1 (expressed in approximate percent, by weight of the overall resulting composition):

TABLE 1

| | Mercosil ™ | Super Mercosil ™ (low Si version) |
|---|---|---|
| Silicon | 17.0–19.0% | 19.0–22.0% |
| Iron | up to 1.2% | up to 1.0% |
| Magnesium | 0.4–0.7% | 0.7–1.3% |
| Copper | up to 0.25% | up to 0.25% |
| Manganese | up to 0.3% | up to 0.3% |
| Zinc | up to 0.1% | up to 0.1% |
| Titanium | up to 0.2% | up to 0.2% |
| Others - Each | up to 0.1% | up to 0.1% |
| Others - Total | up to 0.2% | up to 0.2% |
| Aluminum | balance | balance |

In a preferred embodiment, the level of iron does not exceed about 1.2%, more preferably about 1.0%, still more preferably about 0.6% and further still more preferably about 0.25%.

In preferred aluminum alloy castings, the resulting microstructure preferably exhibits a mean particle size in the range of about 20 to about 60 microns, and more preferably less than about 40 microns.

PATTERN PREPARATION

A preferred material from which to prepare a pattern for use in the method of the present invention is expanded polystyrene ("EPS") (such as may be obtained using a bead starting material available commercially from Arco Chemical Co. under the designation Dylite F271TF). Other suitable materials include, but are not limited to expandable polymethyl methacrylate ("EPMMA"), or mixtures of EPS and EPMMA. Care in the handling of the foam materials to reduce the possibility of voids in the finished casting occasioned by liquid or gaseous degradation or decomposition products (e.g., liquid styrene) during the metal casting process is preferable, as the skilled artisan will appreciate. The skilled artisan should be familiar with these materials and the techniques for making foam patterns. A discussion of the same can be found generally in references such as *Expandable Pattern Casting*, by Raymond W. Monroe (1992), Chs. 5 and 6, hereby incorporated by reference.

By way of summary, in a present preferred embodiment, a suitable amount of an EPS foam bead starting material (such as Arco Dylite F271TF) is preexpanded to a density of about 20.8 gm/liter (1.3 pcf). Preexpansion is achieved preferably using conventional direct steam preexpansion techniques in a suitable direct steam preexpander. The starting material also preferably is conditioned with a suitable amount of pentane, preferably about 2.8 to about 8% by weight of the overall combination, and more preferably about 3.1% by weight. The pentane preferably serves as a blowing agent to accomplish expansion of the polystyrene. Thus, alternative suitable blowing agent materials may likewise be employed.

The polystyrene beads preferably are introduced within a suitable molding tool, and preferably into a cavity defined generally in a scroll member configuration. Preferably the foam molding tool is an aluminum or other suitable metal alloy die for precision molding operations, which has defined therein a cavity that has a shape of a scroll member. The foam molding tool preferably is constructed according to conventional techniques, and is provided with sufficient venting, preferably at the scroll member vane tips (or at any other location potentially susceptible to gas buildup), so that air or other gases liberated from the foam can escape and thereby allow the foam to fill out the scroll member configuration of the pattern and also accomplish a generally smooth surface finish in the resulting pattern. The design of and filling of the pattern tooling may be done using any suitable technique. See generally, *Expandable Pattern Casting,* by Raymond W. Monroe (1992), Ch. 5.

Preferably, after the beads are introduced into the cavity of the tooling, steam is introduced into a steam chamber in proximate thermal relation with the cavity to react the beads. Preferably the time for which the steam is applied, the steam pressure and the resulting tool temperature are sufficient to produce good fusion of the expanded foam throughout all sections of the scroll member pattern, particularly including the vanes and yet is sufficient to avoid a beady surface finish or bead collapse.

For example, without limitation, in one preferred embodiment, the application of steam (e.g., as produced in a suitable boiler under a pressure of about 173 KPa to about 345 KPa (about 25 to about 50 psig) at no more than a mild superheat) to accomplish this reaction step entails a two step steam application method. In the first step, the fusion step for initiating bonding of the beads, steam is flowed through the tooling for about 8 to about 12 seconds, and more preferably about 10 seconds, at a pressure of about 83 KPa (12 psig) to about 124 KPa (18 psig) and more preferably about 103 KPa (15 psig). The temperature within the tooling thereby is brought to about 60 to about 90° C. and more preferably about 80° C. by the steam.

The second step, the autoclave step occurs substantially immediately following the fusion step, and entails introducing steam into the tooling at a temperature high enough to result in a tool temperature of about 110° C. to about 120° C., and more preferably about 115° C.; and a pressure of about 83 KPa (12 psig) to about 124 KPa (18 psig) , and more preferably about 103 KPa (15 psig); and for a time of about 8 to about 12 seconds and more preferably about 10 seconds. of course, these parameters may vary depending on such factors, without limitation, as the materials used, the type of tooling, the size and shape of the scroll member and other variables within the contemplation of one skilled in the art. The skilled artisan should be able to anticipate these and adjust the parameters accordingly, without undue experimentation.

Any suitable foam molding machine may be employed. Without limitation one or more suitable machines are available from Vulcan Engineering of Helena, Ala.

Preferably, after the autoclave step, the pattern is removed from the tool and allowed to age in ambient air at a suitable temperature (e.g., about 20° to 54° C.) for a suitable time (preferably at least about five (5) days) to assure that dimensional stability is achieved in the resulting pattern.

For some configurations, such as complex configurations, multiple pattern sections may be made and assembled together to define the pattern for the overall component. While it may be possible to make a pattern that includes one or more of the necessary sprues, runners, risers, gating, or other patterns for casting, it is desirable also to assemble such components to the scroll member pattern itself after the scroll member pattern portion has been aged. Conventional pattern section assembly techniques may be employed, such as described in *Expandable Pattern Casting,* by Raymond W. Monroe (1992), Ch. 6, incorporated by reference.

In a preferred method, the scroll member pattern and other parts are joined together with a suitable adhesive, preferably a conventional hot melt adhesive such as, without limitation, Hotmelt GA1467 available commercially from Grow Group Automotive Division. Preferably the amount of the adhesive is slight to avoid the potential for generation of additional gases that potentially may lead to porosity in the subsequent metal castings. The assembly of the pattern may also employ other suitable joining techniques, whether mechanical or chemical.

In a particularly preferred embodiment, an aged pattern is further coated with a suitable refractory or ceramic coating, typically provided as a water or solvent based refractory slurry. Coating affords various potential advantages such as, without limitation, the ability to burn out the pattern from a mold prior to casting a metal, while still retaining the desired pattern shape. One example of a suitable coating includes, but is not limited to, Styrokote 27 (available commercially from Borden Packaging and Industrial Products (Westchester, Ill.)) for use on a pattern for aluminum alloy casting. Another example includes but is not limited to, Ceramcote EP9KZ 10 C (available commercially from Ashland Chemical Co.) for use on a pattern for casting gray iron.

The coatings may be applied using any conventional technique and preferably following the coating manufacturer's specifications and guidelines, which preferably entails dipping the pattern and then allowing it to air dry either at about room temperature or warmer and either with stagnant air or gently flowing air. Alternative coatings employing quick drying solvent systems may be used as the skilled artisan will appreciate.

PRECASTING MOLDING PRACTICES

Prior to casting, the foam pattern, assembled with appropriate sprue, runners, gates and risers, is placed into a suitable molding tool or container (e.g., a mold flask). To improve yield, the pattern may be assembled with one or more additional patterns, with or without multiple levels. It should be noted that while it is possible that any sprues, runners, gates and risers are assembled to the pattern prior to placement in the flask, they also may be added after placement into the flask, such as after a predetermined amount of refractory material has been added to the flask. Sprue, runner, gate and riser placement may be accomplished in any suitable manner and in any desirable location, taking into account the solidification process of the parts and preferably to facilitate removal during later finishing steps.

The refractory material is added into the flask and is compacted in order to substantially surround the entire foam pattern prior to casting. A preferred refractory material is silica sand having generally granular grains. The grain size of the preferred sand preferably ranges from an American Foundrymen's Society grain fineness number (AFS gfn) of about 25 to about 45, and more preferably about AFS gfn 36. Further, preferably, the silica sand is employed having a grain size distribution that is tight enough for at most about two screens and a loss on ignition (LOI) (i.e., during the pouring of an aluminum alloy) of up to about 0.1%, and more preferably up to about 0.08%.

Preferably, the sand is compacted by vertical compaction, in one or more compacting steps, for a suitable amount of time (e.g., about 15 to about 20 seconds for each compaction). By way of example, without limitation, sand is placed in a suitable container (e.g., a mold flask) and is vibrated or shook in a direction generally parallel to the vertical axis of the container at a suitable acceleration rate (e.g., 0.6 to 4.0 g). Horizontal, a combination of vertical and horizontal compaction techniques, or other suitable techniques alternatively may be used.

Of course, other sands may be employed as the skilled artisan will appreciate. (See generally, *Expandable Pattern Casting*, by Raymond W. Monroe, Ch. 8). Examples of other particularly preferred sands include, without limitation, sands that exhibit relatively low thermal expansion. Examples of such sands include, without limitation, carbon sand, chromite sand, mullite sand, chromite sand, olivine and zircon. (See generally, "The Precision Lost Foam Casting Process", by R.J. Donahue and T. M. Cleary, Mercury Marine, Lost Foam Technologies and Applications Conference Proceedings, Sep. 11–13, 1995 (Akron, Ohio), sponsored by American Foundrymen's Society. As to the Low thermal expansion sands, they exhibit desirable low expansion because, without intending to be bound by theory, at least in part, they do not undergo a phase transformation when they encounter the temperatures commonly associated with the casting of the preferred metals.

Referring to FIG. 1, there is shown a molding tool or mold flask 10 having an open first end 12 and closed second end 14. The flask 10 contains a refractory material 16 that substantially surrounds a pattern 18. The pattern 18 is attached to a sprue 20, which in turn is connected at one of its ends to a pouring cup 22. To achieve a scroll member having a vane configuration such as is depicted in the embodiment of FIGS. 2–4 and 9, and where conventional silica sand is employed as the refractory, a pattern 18 including a vane configuration depicted in FIG. 8 by vane member 24 is employed. A pattern for a lower scroll member as in FIGS. 5–7 and 10 may be configured in a similar elongated manner.

Further, as shown in FIG. 1, preferably the scroll member pattern 18 is oriented so that its longitudinal axis is generally transverse to the longitudinal axis of the flask 10 and the pouring cup 22. This desirably permits the sand to flow into the scroll form of the pattern and to be readily compacted.

Preferably the pouring cup 22 is placed in proximate relationship with the sprue 20 associated with the pattern 18 after the flask 10 is at least partially filled with sand and the pattern is at least partially embedded in the sand.

In a particularly preferred embodiment, the foam pattern is dimensionally configured to take into account the thermal expansion characteristics of the sand or other refractory that is employed, as well as shrinkage of the cast article, as the skilled artisans will appreciate. For instance, where it is anticipated that the sand is going to expand anisotropically (i.e., usually along the vertical axis of the flask toward the open end 12, when a molding tool such as a mold flask having an unconstrained open end is used), the scroll member foam pattern is designed to take into account the anticipated dimensional changes.

Figure 4:
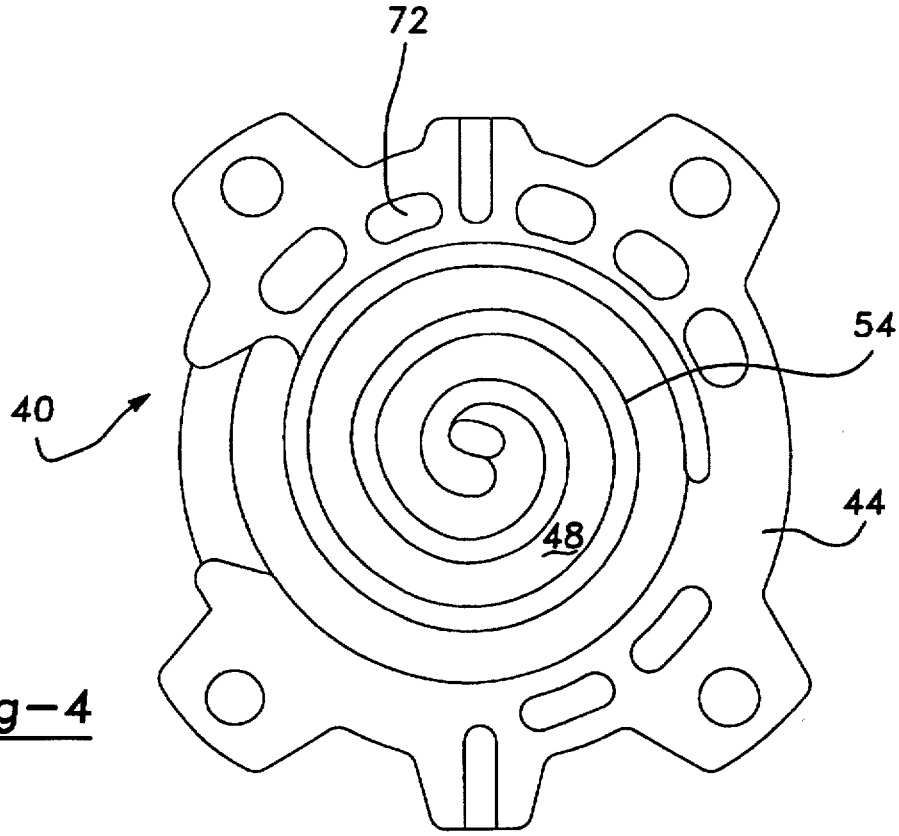
FIG. 4 is a bottom plan view of the casting of FIG. 2.
Figure 5:
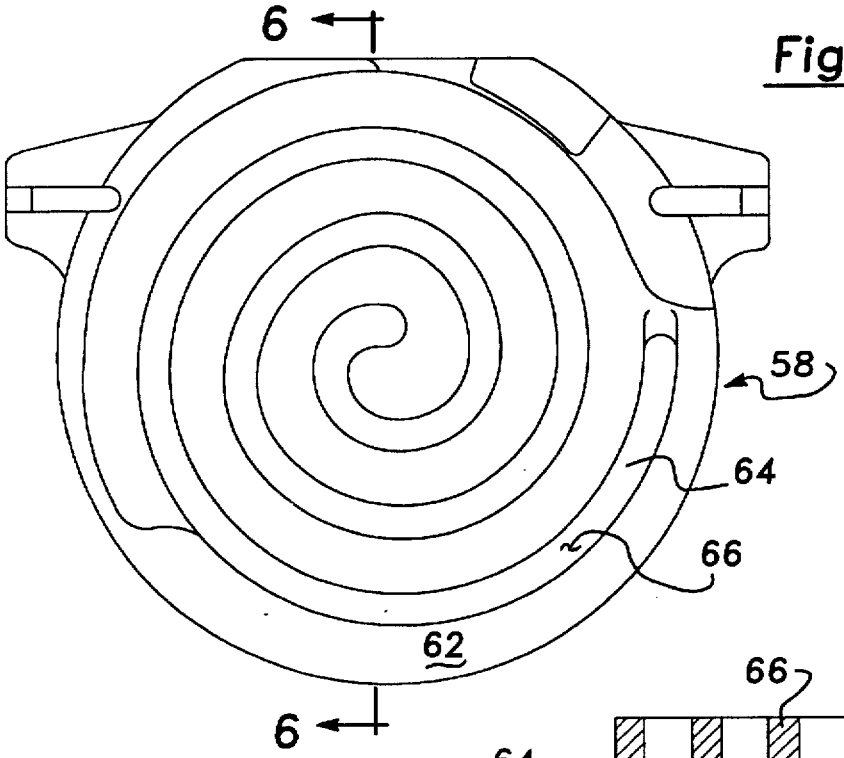
FIG. 5 is a top plan view of a lower scroll member casting.
Figure 6:
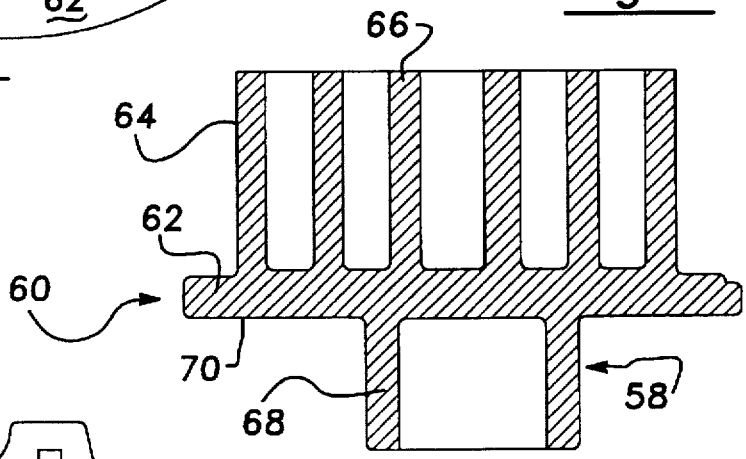
FIG. 6 is a side sectional view (through 6—6) of the casting of FIG. 5.
Figure 7:
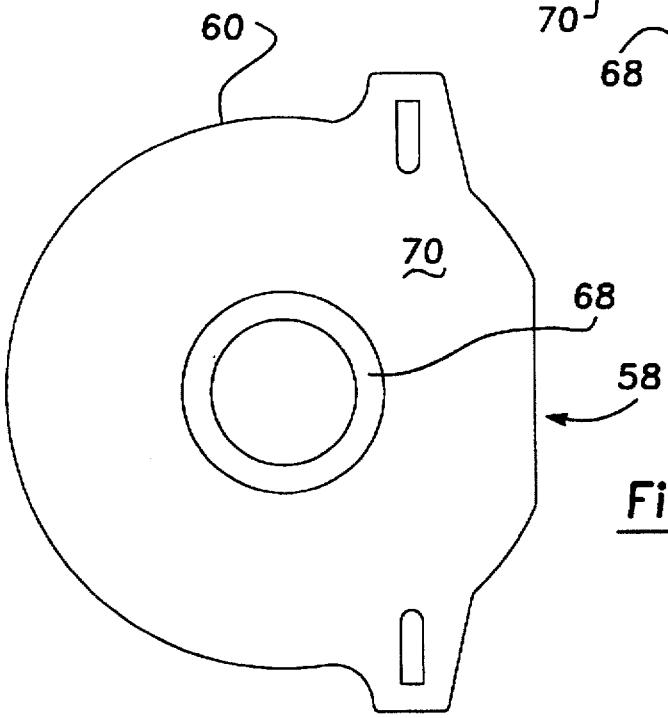
FIG. 7 is a bottom plan view of the casting of FIG. 5.
Figure 8:
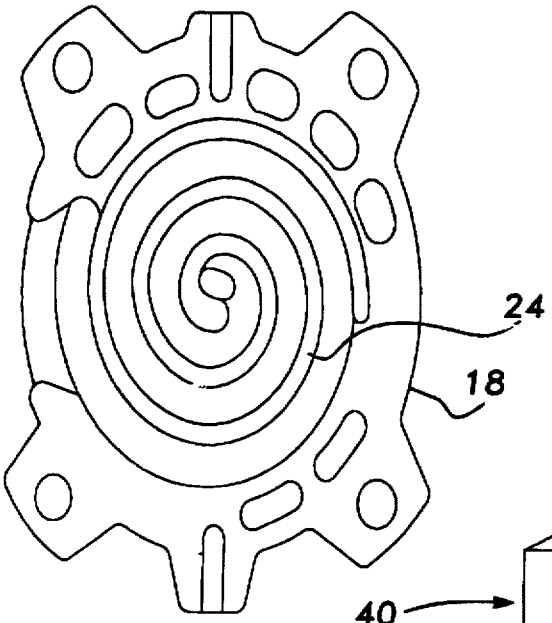
FIG. 8 is a bottom plan view of an upper scroll member pattern.
Figure 9:
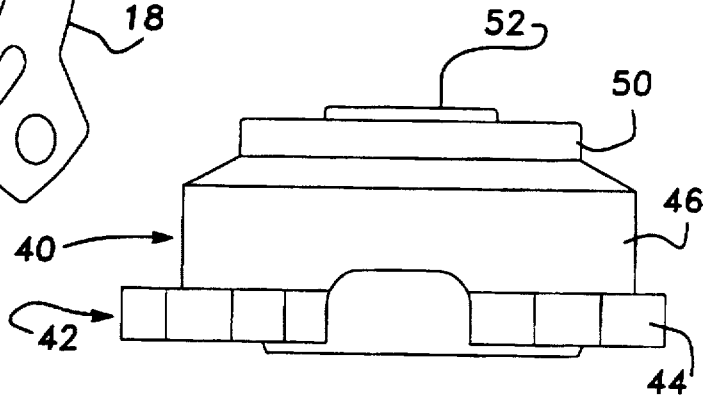
FIG. 9 is a side elevation view of the scroll member of FIG. 2.
Figure 10:
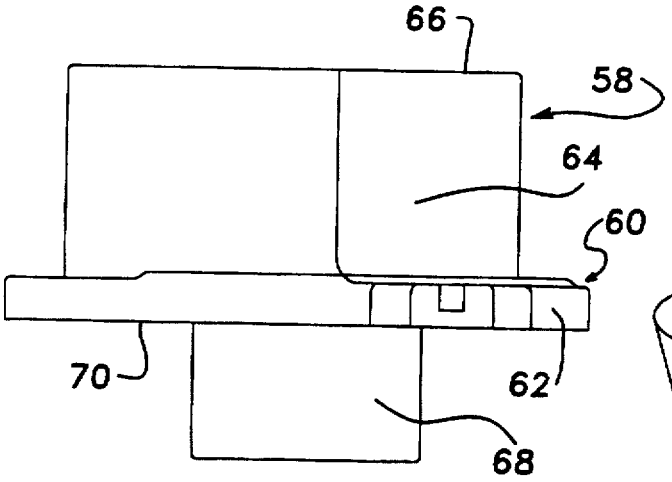
FIG. 10 is a side elevation view of the scroll member of FIG. 5.

To illustrate, referring to FIG. 8, where a first vane configuration in a scroll member is desired in the final cast product (such as is shown in FIG. 4), and a conventional silica sand is used, a second vane configuration 24 and overall elongated scroll member configuration is prepared in the pattern 18 (i.e., the pattern is elongated along at least one of its axes relative to the others in order to take into account and compensate for thermally induced distortion, namely that occasioned by sand expansion, material shrinkage or both). In this manner, the pattern 18 (such as in FIG. 8) can be oriented in the flask so that even after sand expansion and shrinkage, the final resulting cast scroll member will be generally the desired as cast shape, such as in FIG. 4. These principles can also be applied to make a pattern for achieving other scroll members, such as in FIG. 5.

INOCULATION DURING POURING

Figure 11:
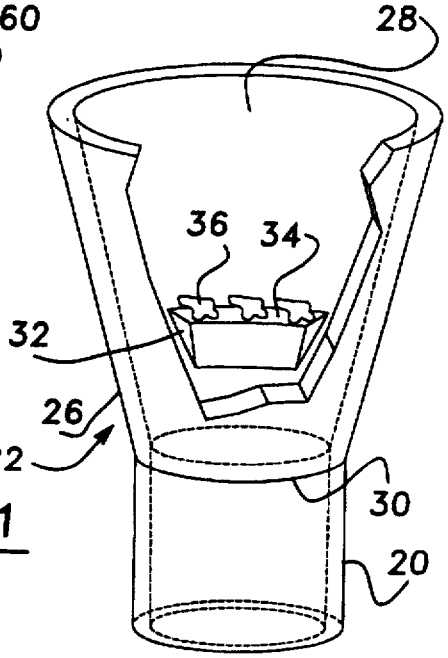
FIG. 11 is a cutaway perspective view of a pouring cup.

In one particularly preferred embodiment, the molten metal is inoculated during pouring. In an even more particularly preferred embodiment, for applications involving the casting of a scroll member, the pouring cup 22 has the configuration depicted in FIG. 11. The pouring cup of FIG. 11 has a generally frustoconical wall 26 that defines an open mouth 28 at a first end for receiving molten metal and also an open end 30 that connects with the downsprue 20 for permitting molten metal to flow therethrough during metal pouring. On the inside of the wall 26, and near the open end 30, there is defined a ledge 32 that extends radially inward relative to the wall 26. The ledge 32 may extend around all or part of the circumference of the wall. The ledge 32 has a surface 34 with sufficient area onto which one or more inoculant masses 36 (e.g., lumps or preforms) may be placed (either free standing or attached with a suitable refractory cement, such as NF10 commercially available from Arcilla (of Mexico)). In-mold inoculation of the molten metal, such as to modify the microstructure of the material (e.g., by coarsening pearlite, or otherwise modifying the graphite or matrix structure, in a gray iron) may thereby be accomplished, consistent with the teachings in copending, commonly owned U.S. application, Ser. No. 08/403,455 and now issued as U.S. Pat. No. 5,580,401, incorporated by reference. The pouring cup may be made of any suitable material such as, without limitation, a shell bonded silica sand or a suitable refractory fiber.

The type and amount of inoculant may vary as desired. By way of example, without limitation, an inoculant may be employed having a suitable composition (e.g., having a composition including about 73 to about 78% silicon, about 0.6 to about 1.0% strontium, and iron) for inoculating a casting a gray iron. Molten metal will thus carry the inoculant material into the mold where it will interact with the molten metal during solidification.

The step of in-mold inoculating the molten metal is particularly preferred for casting lower scroll members (orbiting scroll members, which tend to have relatively thin sections), but is not necessarily confined to treating lower scroll members or to treating molten gray iron. Inoculants may suitably be employed with aluminum casting alloys. For example, without limitation, a Mercosil® alloy may be inoculated with approximately 8% phos-copper shot at about a 0.3% by weight of the molten metal being inoculated. Alternative inoculation techniques may be employed (e.g., ladle inoculation, strainer core or filter inoculation).

CASTING

Once the mold is filled with sand and all necessary gates, risers, runners, sprues and the pouring cup are in place, molten metal can be poured into the mold. Preferably gray iron is poured at a molten metal temperature of about 2510° F. (1377° C.) to about 2640° F. (1449° C.). For a Mercosil® aluminum alloy, in contrast, the pouring temperature ranges from about 730° C. to about 900° C. and more preferably is about 790° C. Higher or lower temperatures are possible depending on such factors as the size of the desired scroll member, metal composition and other considerations that the skilled artisan will appreciate.

When the hot molten metal contacts the plastic foam pattern, if the pattern is not burned out prior to pouring (e.g., by heating to a suitable temperature such as one on the order of about 600° C. for an EPS scroll member pattern), the pattern preferably will decompose and liberate gases. The gases preferably escape from within the thereinafter defined mold cavity, through any suitable venting configuration for allowing the gases to dissipate through voids in the surrounding refractory (e.g., sand). Whether the pattern is burned out by contacting with molten metal during pouring, or in a step prior to pouring, preferably, sufficient metal is poured so that the metal will fill out the cavity and result in a near net finished scroll member.

After casting, preferably for a gray iron, cooling is permitted to a temperature low enough so that upon shake out and subsequent air cooling at such temperature, preferably an HB above about 241 is avoided in the casting and self annealing preferably to less than about HB 187 is also avoided. The time and temperature will vary depending on a range of factors such as the size and shape of the cast article. Shake out is accomplished by inverting the mold flask in any suitable manner. The shake-out step may occur from about 25 minutes to about 90 minutes after pouring. Higher or lower times, of course, may be employed. For an aluminum alloy, the time elapsed prior to shake out, after pouring,. is sufficient for the cast material to withstand the rigors of shake out and remain substantially free of deformation caused by the shake out step. Typically shake out times for aluminum alloy parts are shorter than for like gray iron parts, preferably on the order of about one half the amount of time.

Cast articles may be cleaned and finished using conventional techniques such as, without limitation, cutting, grinding and fracturing for removal from the grating system and by shot or abrasive blasting for removal of adhering sand or refractory.

Turning to FIGS. 2–7 and 9–10, these figures depict, generally, improved scroll members that are achieved relatively efficiently and economically using the method of the present invention.

Referring to FIGS. 2–4 and 9, these depict a preferred upper scroll (or fixed scroll) member casting. FIGS. 5–7 and 10 depict a preferred lower scroll (or orbiting scroll) member casting. The scroll members of FIGS. 2–4 and 9, and 5–7 and 10 can be employed in co-acting combination with one another as the skilled artisan will appreciate. The upper scroll member 40 includes a first base portion 42 having a first plate member 44, a wall 46 depending from the first plate member, and a second plate member 48. A sealing flange 50 extends away from the second plate member 48 about the periphery of the latter. A sealing collar 52 within the sealing flange 50 extends away from the second plate member 48. A first spiroidal vane member 54 extends from a surface of the second plate member 48 opposite the surface from which the sealing collar 52 originates. The vane member 54 terminates at a vane tip or free end 56.

Referring to FIGS. 5–7 and 10, there is shown an example of a preferred lower (orbiting) scroll member 58. The scroll 58 has a second base portion 60. The base portion 60 includes a third plate member 62 defining a surface from which a second spiroidal vane member 64 extends. The vane member 64 terminates at a vane tip or free end 66. A hub 68 extends from a surface 70 in a direction away from the second spiroidal vane member 64.

The skilled artisan will appreciate that the drawings herein are for illustration purposes only (e.g., to demonstrate the geometric intricacies of scrolls) and are not intended as limiting. The present invention contemplates its usefulness in many different scroll structures, other than those shown.

Figure 2:
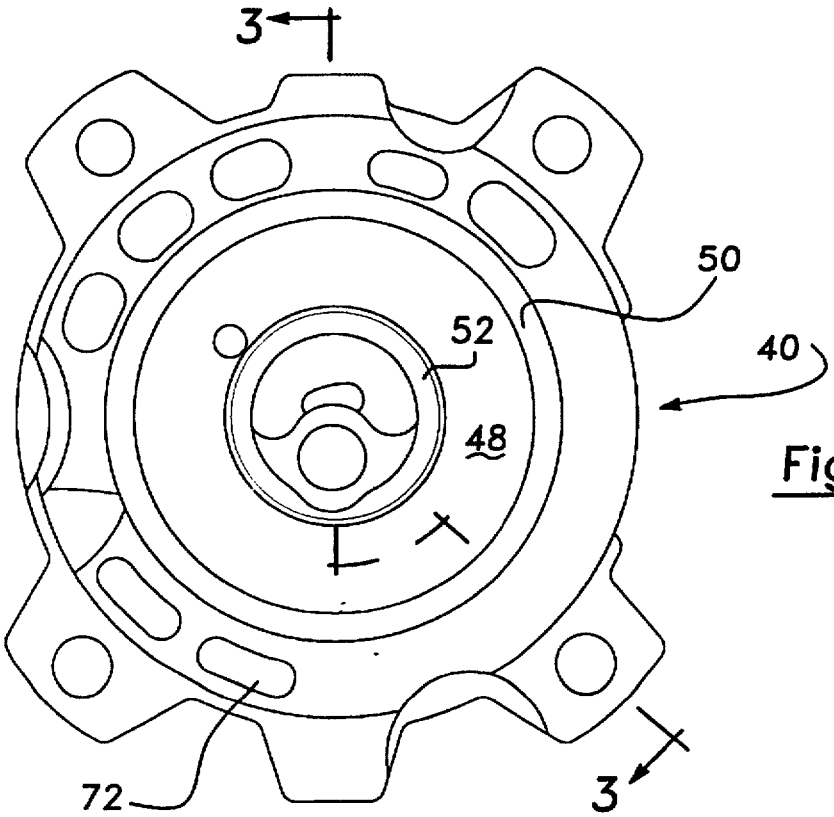
FIG. 2 is a top plan view of an upper scroll member casting.

Noteworthy, in the scrolls of FIGS. 2–4 and 9 is the inclusion of at least one and preferably a plurality of holes 72 (some of which are designated, without limitation, by reference numeral 72) defined in the first plate member 44 of the upper scroll 40. The holes may be blind holes or through holes, but are shown for illustration purposes as through holes. The holes 72 are preferably oval in shape and resemble a racetrack. FIGS. 2 and 4 illustrate the employment of seven of such racetrack shape holes 72. Other noncircular shapes may be employed as well, such as (without limitation)triangular, quadrilateral and other polygonal shapes. A hole having an undercut feature may be defined as well. An advantage of the present invention is that foam patterns having these holes already defined therein may be employed in the casting process obviating the need for cores during the actual casting process.

As can be gleaned from the above, many advantages over previous method are possible through the use of the method of the present invention.

Among the many advantages are that scroll members can advantageously be cast and achieve high dimensional accuracies in the as-cast state. Further, coring operations can be eliminated during the metal casting step of the method thereby overcoming many of the disadvantages of using cores. Scroll members having relatively smooth surface finishes and that are substantially free of sand mold parting lines and other potentially undesirable attributes associated with conventional cope and drag sand molding techniques can also be achieved. Further, employment of the method of the present invention with the preferred pouring cup, permits for simplified in mold inoculation, particularly where casting thin sectioned gray iron scroll members.

Further, casting according to the present method economically achieves scroll members that are reduced in overall mass relative to conventional scroll members by the generation of holes or recesses in heretofore difficult to achieve locations absent the use of cores, and without the need for substantial post-casting finishing or machining operations. Further, the molding of structure to define through or blind holes in thicker sections of the casting permits for the reduction of burn-in phenomena by the reduction of mass in that region. Further, the use of the present invention permits for accommodation of sand thermal expansion and results in scroll components having improved dimensional accuracy along all axes. Further, the elimination of cores in the metal casting steps permits for the formation of interior and reentrant casting features, thus facilitating complex designs and aiding in the control of wall thickness; and also creating the opportunity for component consolidation. Moreover, in this regard, core prints are substantially eliminated as are core fins, core shift and other core defects. Core sand coating or mixing may also be obviated.

While the above detailed description describes the preferred embodiment of the present invention, it should be understood that the present invention is susceptible to modification, variation and alteration without deviating from the scope and fair meaning of the subjoined claims.

What is claimed is:

1. A method for casting a scroll member, comprising the steps of:

a) placing a pattern configured as a scroll member into a molding tool;

b) surrounding substantially the entirety of said pattern with a first refractory material;

c) decomposing said pattern in order to define a cavity having the configuration of said pattern; and d) pouring a sufficient quantity of a molten metal into said molding tool in order to fill the cavity defined by said pattern to obtain a cast scroll member upon solidification of said molten metal.

2. A method according to claim 1, wherein said decomposing step (c) comprises contacting said pattern with said molten metal.

3. A method according to claim 1, wherein said pattern is prepared from a material including expanded polystyrene.

4. A method according to claim 1, wherein said pattern is prepared from a material including expanded polymethylmethacrylate.

5. A method according to claim 1, wherein said metal is a gray iron alloy.

6. A method according to claim 1, wherein said metal is an aluminum alloy.

7. A method according to claim 1, wherein said first refractory material is silica sand.

8. A method according to claim 1, further comprising (e) coating said pattern with a second refractory material prior to said decomposing step (c).

9. A method for casting a scroll member, comprising the steps of:

a) placing a foamable composition Into a molding tool and foaming said composition to form a scroll member pattern;

b) surrounding said pattern with a first substantially granular refractory material;

c) decomposing said pattern In order to define a cavity having the configuration of said pattern; and d) introducing a sufficient quantity of a molten metal into said molding tool in order to fill the cavity defined by said pattern to obtain a cast scroll member upon solidification of said molten metal.

10. The method according to claim 9, wherein said refractory material is compacted prior to decomposing said pattern.

11. The method according to claim 9, wherein said decomposing step (c) comprises contacting said pattern with said molten metal.

12. The method according to claim 9, wherein said pattern is prepared from a material selected from the group consisting of expanded polystyrene and polymethyl methacrylate.

13. The method according to claim 9, wherein said metal is selected from the group consisting of gray iron and aluminum alloys.

14. The method according to claim 9, wherein said first substantially granular refractory material includes silica sand.

15. The method according to claim 14, wherein said silica sand has an average grain fineness of between about 25 to about 45.

16. The method according to claim 9, further comprising (e) coating said pattern with a second refractory material prior to said decomposing step (c).

17. The method according to claim 9, wherein said molten metal is rapidly cooled to avoid fading of innoculants just prior to being Introduced into said molding tool.

* * * * *

UNITED STATES PATENT AND TRADEMARK OFFICE

CERTIFICATE OF CORRECTION

PATENT NO. : 5,755,271

DATED : May 26, 1998

INVENTOR(S) : Warren G. Williamson

It is certified that error appears in the above-indentified patent and that said Letters Patent is hereby corrected as shown below:

Column 8, line 8, "Mercosil™" should be -- Mersocil® --.

Column 8, line 9, "Mercosil™" (second occurrence) should be -- Mercosil® --.

Column 9, line 40, begin new paragraph with "Of course, these".

Column 11, line 11, "Low" should be -- low --.

Column 12, line 31, delete "a".

Column 15, line 17, "Into" should be -- into --.

Column 15, line 22, "In" should be -- in --.

Column 16, line 26, "Introduced" should be -- introduced --.

Signed and Sealed this

Twenty-fourth Day of November, 1998

*Attest:*

Bruce Lehman

BRUCE LEHMAN

*Attesting Officer*

*Commissioner of Patents and Trademarks*